US008452212B2

(12) United States Patent
Rokutan et al.

(10) Patent No.: US 8,452,212 B2
(45) Date of Patent: May 28, 2013

(54) CHARGING MEMBER, PROCESS UNIT CARTRIDGE, AND IMAGE FORMING APPARATUS

(75) Inventors: Minoru Rokutan, Kanagawa (JP); Shogo Tomari, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 321 days.

(21) Appl. No.: 13/015,886

(22) Filed: Jan. 28, 2011

(65) Prior Publication Data

US 2012/0070193 A1 Mar. 22, 2012

(30) Foreign Application Priority Data

Sep. 21, 2010 (JP) ..... 2010-210869

(51) Int. Cl.
*G03G 15/02* (2006.01)

(52) U.S. Cl.
USPC ..... 399/176

(58) Field of Classification Search
USPC ..... 399/174, 176; 492/18, 30
See application file for complete search history.

(56) References Cited

U.S. PATENT DOCUMENTS 7,462,146 B2 * 12/2008 Nagata ..... 492/30
8,275,292 B2 * 9/2012 Tomari et al. ..... 399/176

FOREIGN PATENT DOCUMENTS

JP A-9-297454 11/1997
JP A-2006-117870 5/2006

* cited by examiner

*Primary Examiner* — William J Royer
(74) *Attorney, Agent, or Firm* — Oliff & Berridge, PLC

(57) ABSTRACT

A charging member includes a conductive metal shaft and a conductive elastic layer. The conductive elastic layer comprises a rubber material containing 50% to 100% by weight of epichlorohydrin rubber containing 56 mol % or more of an ethylene oxide and a calcium oxide having an average particle size D50 of 18 μm or smaller.

9 Claims, 1 Drawing Sheet

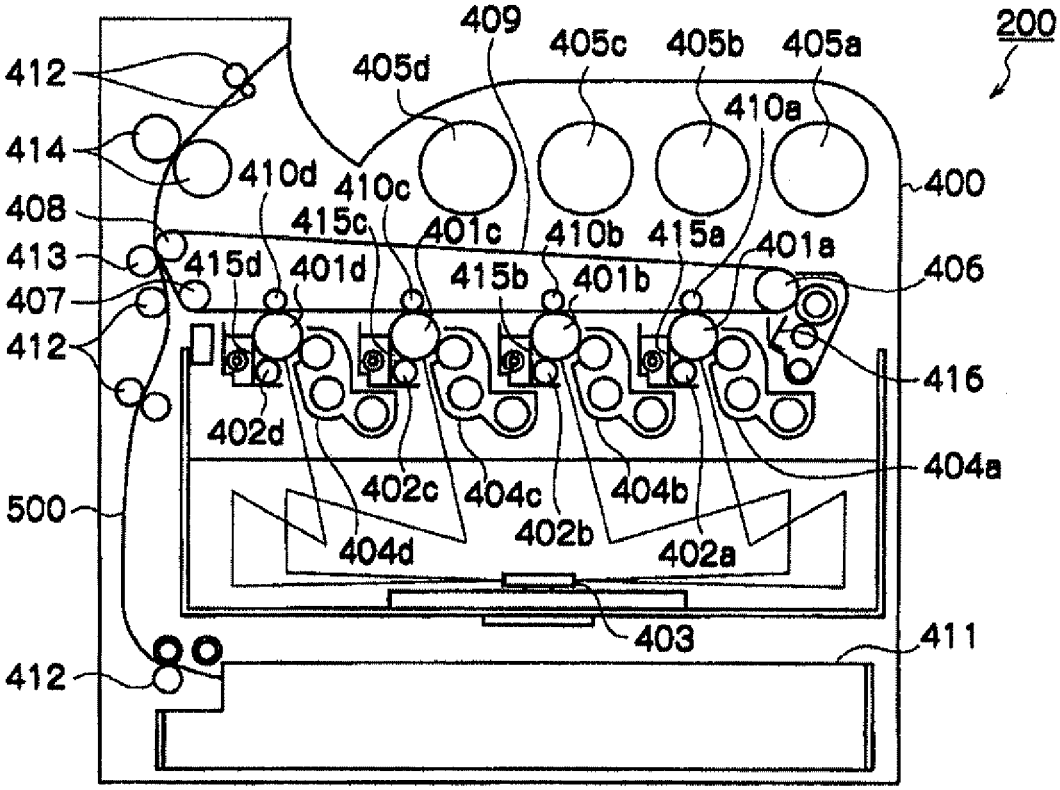
200
409
405c
405b
405a
405d
412
414
410a
410d
410c
400
408
415c
401c
410b
415a
401a
413
415d
401d
415b
401b
406
407
412
416
402d
404a
402c
404c
404b
500
402b
404d
402a
403
411
412

CHARGING MEMBER, PROCESS UNIT CARTRIDGE, AND IMAGE FORMING APPARATUS

CROSS-REFERENCE TO RELATED APPLICATION(S)

The present application claims priority from Japanese Patent Application No. 2010-210869 filed on Sep. 21, 2010, the entire content of which is incorporated herein by reference.

BACKGROUND

1. Field

The present invention relates to a charging member, a process unit cartridge, and an image forming apparatus.

2. Description of the Related Art

Conventional electrophotographic image forming apparatus, such as copiers and printers, have mostly used a charger utilizing a corona discharge phenomenon, such as a scorotron. However, such chargers generate ozone and nitrogen oxides. Therefore, as a charger used for electrophotographic image forming apparatus, contact type chargers that an image carrier is charged by having a conductive charging member in direct contact with the image carrier have recently prevailed.

There is an increasing demand for a less resistant charging member for use in contact type chargers from the viewpoint of higher speed, higher image quality, and longer life. A charging member has been produced by a method in which a rubber material is shaped by pressing or injection molding, and is vulcanized, and then shaped molding is ground so as to obtain a desired shape and surface roughness. In recent years, the users' demand for cost reduction has boosted the use of lower cost processing techniques, including extrusion molding that achieves good productivity, omission of the grinding to reduce the number of the manufacturing steps, and vulcanization at atmospheric pressure that can be carried out with inexpensive equipment.

Methods for making a charging member include a molding method using a mold such as injection molding, a method in which an unvulcanized rubber is extruded into a tube, vulcanizing the extruded tube, and inserting a cylindrical metal shaft into the tube, and a method in which an extruder is equipped with a crosshead die, and an unvulcanized rubber covers a metal shaft, and then vulcanized. The latter two of the methods are becoming predominant, in which a rubber cylinder is obtained using an extruder that favors the reduction of processing cost.

SUMMARY

<1> A charging member having: a conductive metal shaft; and a conductive elastic layer on the shaft, wherein the conductive elastic layer has: a rubber material; and a calcium oxide having an average particle size D50 of 18 μm or smaller, wherein the rubber material contains 50% to 100% by weight of epichlorohydrin rubber containing 56 mol % or more of an ethylene oxide.

BRIEF DESCRIPTION OF DRAWINGS

FIG. 1 schematically illustrates the configuration of an image forming apparatus according to the invention.

DETAILED DESCRIPTION OF EXEMPLARY EMBODIMENTS

The following describes exemplary embodiments of the charging member, the process unit cartridge, and the image forming apparatus according to the invention.

[Charging Member]

The charging member according to the invention includes a conductive metal shaft and a conductive elastic layer. The conductive elastic layer has a rubber material containing 50% to 100% by weight of an epichlorohydrin rubber containing at least 56 mol % of ethylene oxide and a calcium oxide having an average particle size D50 of 18 μm or smaller.

When an epichlorohydrin rubber having an ethylene oxide unit is used as the conductive elastic layer provided in the charging member, the conductive elastic layer having lower resistance and reduced variation in resistance than other rubbers. An increase in ethylene oxide content will result in further reduction in resistance of the charging member. However, because ethylene oxide is hydrophilic, too high an ethylene oxide content in the epichlorohydrin rubber can cause vaporization of more water content than necessary during extrusion, resulting in excessive foaming. It is likely to follow that the extruded layer has larger surface roughness than intended. Then, in the present invention, an epichlorohydrin rubber contains at least a specific amount of ethylene oxide is used to make a charging member having predetermined low resistance, and a calcium oxide having an average particle size D50 of 18 μm or smaller and having predetermined specific surface area, which absorbs excess of the water content in the rubber material.

The epichlorohydrin rubber that can be used in the invention contains at least 56 mol %, preferably 60 mol % or more, more preferably 70 mol % or more, of ethylene oxide. By conducting vulcanization of the rubber material containing epichlorohydrin rubber used in the invention, the unvulcanized rubber material containing the ethylene oxide-containing epichlorohydrin rubber provides a charging member having high-speed operability, an extended life, and reduced resistance variation. If the ethylene oxide content in the epichlorohydrin rubber is less than 56 mol %, a predetermined resistance cannot be obtained. Also, the rubber material can contain well-known rubber materials other than the epichlorohydrin rubber containing ethylene oxide in amount of 56 mol % or more. For example, liquid acrylonitrile butadiene copolymer rubber or epichlorohydrin rubber containing ethylene oxide in amount of less than 56 mol % can be preferably used.

Calcium oxide used in the conductive elastic member of the charging member has an average particle size D50 of 18 μm or smaller, preferably 14 or smaller, more preferably 6 μm or smaller. The calcium oxide is preferably present in an amount of 1 to 15 parts, more preferably 3 to 10 parts, by weight based on 100 parts by weight of the rubber material. With the calcium oxide content falling within the ranges, excessive foaming during vulcanization is prevented, and the vulcanized and molded rubber material exhibits satisfactory surface properties without needs of grinding.

The particle size of the calcium oxide to be added is determined with a particle size analyzer, for example, a laser diffraction particle size analyzer SALD-2000 available from Shimadzu Corp. The particle size of the calcium oxide present in the conductive elastic layer is determined by observing a cross-section of the conductive elastic member using, for example, a scanning electron microscope or a transmissive electron microscope.

The charging member of the invention preferably has a ten point average surface roughness Rz of 15 μm or less, more preferably 10 μm or less, even more preferably 8 μm or less, to control the variations in resistance and charge of the charging member.

The ten point average surface roughness Rz was measured with a surface profilometer SURFCOM 1500DX-12 from Tokyo Seimitsu Co., Ltd. in accordance with JIS B0601-1994.

While the charging member of the invention may be produced by any method, for example, if not metal molding method but extrusion molding method is used, the rubber material containing the epichlorohydrin rubber may be vulcanized at atmospheric pressure, and the step of grinding may be omitted. As compared with shaping in a metal molding, extrusion molding is highly productive and requires less capital investment and less operational cost for the production of the charging member.

If desired, the conductive elastic layer may have a stain proof or bleed proof surface layer. Such a surface layer may suitably be provided by any general coating technique, such as dip coating, spraying, roller coating, or flow coating, or by putting a tube over the elastic layer.

The metal shaft of the charging member is usually made of iron, copper, brass, stainless steel, aluminum, nickel, or the like. A free cutting steel shaft as shown in JIS G4804 plated with chromium, nickel, or the like may also be used. The conductive metal shaft may be either roll or hollow in shape.

Examples of the vulcanizing agent used to vulcanize the rubber material include sulfur and compounds that withdraw a halogen group to achieve crosslinking, such as 2,4,6-trimercapto-s-triazine and 6-methylquinoquixaline-2,3-dithiocarbamate. Examples of useful vulcanization accelerators include thiazoles series, sulfonamides series, thiurams series, dicarbamic acid salts series, and xanthogenic acid salts series. Both the vulcanizing agents and the vulcanization accelerators may be used individually or as a combination of two or more thereof. The rubber material may further be combined with known rubber compounding materials, such as zinc oxide and stearic acid.

The conductive elastic layer may further contain an organic ion conductive substance. Examples of the organic ion conductive substance include quaternary ammonium salts, such as a perchlorate, a chlorate, a tetrafluoroborate, a sulfate, an ethosulfate, and a halogenated benzyl salts (e.g., benzyl bromide and benzyl chloride) of lauryltrimethylammonium, stearyltrimethylammonium, octadodecyltrimethylammonium, dodecyltrimethylammonium, hexadecyltrimethylammonium, benzyltrimethylammonium, benzyltriethylammonium, benzyltributylammonium, benzyltrioctylammonium, or modified fatty acid-dimethylethylammonium; aliphatic sulfonic acid salts, higher alcohol sulfuric ester salts, higher alcohol ethylene oxide adduct sulfuric ester salts, higher alcohol phosphoric ester salts, higher alcohol ethylene oxide adduct phosphoric ester salts; various betaines; higher alcohol ethylene oxide adducts, polyethylene glycol fatty acid esters, and polyhydric alcohol fatty acid esters.

Further included in the organic ion conductive substance are complexes of polyhydric alcohols (e.g., 1,4-butanediol, ethylene glycol, polyethylene glycol, and propylene glycol) or their derivatives and metal salts, and complexes of monools (e.g., ethylene glycol monomethyl ether and ethylene glycol monoethyl ether) and metal salts. Examples of the metal salts include salts of Group 1 of the Periodic Table, such as $LiClO_4$, $LiCF_3SO_3$, $LiAsF_6$, $LiBF_4$, $NaClO_4$, NaSCN, KSCN, and NaCl; electrolyte, such as $NH^{4+}$ salts; salts of Group 2 of the Periodic Table, such as $Ca(ClO_4)_2$ and $Ba(ClO_4)_2$; and derivatives of these metal salts having at least one active hydrogen-containing group reactive with isocyanate (such as hydroxyl, carboxyl, or primary or secondary amino). The complexes described are exemplified by a complex of $LiClO_4$ and polyethylene glycol.

The conductive elastic layer preferably has a thickness of about I/O to 4.5 mm, more preferably 1.5 to 4.0 mm, and a volume resistivity of $10^3$ to $10^{14}$ Ωcm.

The surface layer is made of a resin containing, according to necessity, a conducting agent and other additives.

Examples of the resin include acrylic resins, cellulose resins, polyamide resins, copolymer nylons, methoxymethylated nylon, ethoxymethylated nylon, polyurethane resins, polycarbonate resins, polyester resins, polyethylene resins, polyvinyl resins, polyallylate resins, styrene butadiene resins, melamine resins, epoxy resins, urethane resins, silicone resins, fluororesins (e.g., tetrafluoroethylene perfluoroalkyl vinyl ether copolymers, tetrafluoroethylene hexafluoropropylene copolymers, and polyvinylidene fluoride), and urea resins. The term "copolymer nylon" denotes a copolymer composed of at least one polymer unit selected from nylon 610, nylon 11, and nylon 12. The copolymer nylon may contain other polymer units, such as nylon 6 and nylon 66. The resin for the surface layer may be the same rubber material as used to form the conductive elastic layer.

Examples of the additives include those commonly used in a surface layer, such as softeners, plasticizers, curing agents, vulcanizing agents, vulcanization accelerators, antioxidants, surfactants, and coupling agents.

The surface layer preferably has a thickness of 3 to 25 μm and a volume resistivity of $10^3$ to $10^{14}$ Ωcm.

The surface layer is provided on the conductive elastic layer by, for example, blade coating, Meyer bar coating, spraying, dip coating, bead coating, air knife coating, or curtain coating.

The image forming apparatus according to the invention will be described with reference its exemplary embodiment illustrated in FIG. 1.

In the image forming apparatus 200 of FIG. 1, four electrophotographic photoreceptors 401*a*, 401*b*, 401*c*, and 401*d* are arranged in series along the moving direction of an intermediate transfer belt 409 in a housing 400. The photoreceptors 401*a*, 401*b*, 401*c*, and 401*d* are adapted to form, for example, a yellow, a magenta, a cyan, and a black color image, respectively.

Each of the photoreceptors 401*a* to 401*d* is rotatably driven in predetermined direction (anticlockwise direction in FIG. 1), and along with the direction of rotation thereof, a charging roller 402*a*, 402*b*, 402*c*, or 402*d*, a developing unit 404*a*, 404*b*, 404*c*, or 404*d*, a first transfer roller 410*a*, 410*b*, 410*c*, or 410*d*, and a cleaning blade 415*a*, 415*b*, 415*c*, or 415*d* are arranged. Toners of four colors, e.g., yellow, magenta, cyan, and black, are supplied from the respective toner cartridges 405*a*, 405*b*, 405*c*, and 405*d* to the respective developing units 404*a* to 404*d*. The first transfer rollers 410*a* to 410*d* are in contact with the respective photoreceptors 401*a* to 401*d* via the intermediate transfer belt 409.

At a prescribed position in the housing 400 is placed an exposure unit 403 that applies a light beam to the surface of the charged photoreceptors 401*a* to 401*d*. By this configuration, charging, exposure, development, first transfer, and cleaning are performed on each rotating photoreceptor 401*a* to 401*d*, and the toner images of four different colors on the photoreceptors 401*a* to 401*d* are sequentially deposited in superimposed registration on the intermediate transfer belt 409.

The charging rollers 402*a* to 402*d* are in contact with the peripheral surface of the respective photoreceptors 401*a* to 401*d* and uniformly apply a voltage to the respective 401*a* to 401*d* to charge the surface of the 401*a* to 401*d* to a predetermined potential (charging step).

The exposure unit 403 may be an optical device capable of imagewise exposure by applying light beam from a light source, such as a semiconductor laser, a light emitting diode, or a liquid crystal shutter, to the surface of the photoreceptors 401*a* to 401*d*. In particular, an exposure unit that emits incoherent light is preferred to prevent an interference fringe from occurring between the conductive substrate and the photosensitive layer of the photoreceptors 401*a* to 401*d*.

The developing units 404*a* to 404*d* may be of any type in which a two-component developer for developing an electrostatic latent image is used in a contact or non-contact manner to visualize the latent image with a toner (development step). Also, developer in the invention may be not limited to a two-component developer. The developing units 404*a* to 404*d* may be chosen from known developing devices using the two-component developer depending on any purpose. In the first transfer step, a first transfer bias of opposite polarity to the toner adhering to the photoreceptors 401*a* to 401*d* is applied to the first transfer rollers 410*a* to 410*d*, whereby the toner images of different colors are sequentially transferred from the 401*a* to 401*d* to the intermediate transfer belt 409.

The cleaning blades 415*a* to 415*d* remove residual toners adhering to the surface of the respective 401*a* to 401*d* after the first transfer so that the 401*a* to 401*d* may be subjected to the next cycle of image formation as described above. The cleaning blades 415*a* to 415*d* may be made of urethane rubber, neoprene rubber, silicone rubber, or the like material.

The intermediate transfer belt 409 is supported by a driving roller 406, a tension roller 407, and a backup roller 408 with predetermined tension, and thereby the intermediate transfer belt 409 can rotate without sagging by rotating of these roller these rollers. A second transfer roller 413 is disposed in contact with the backup roller 408 via the intermediate transfer belt 409.

A second transfer bias of polarity opposite to the toner on the intermediate transfer belt 409 is applied to the second transfer roller 413, whereby the second transfer roller 413 transfers the multi-colored toner image on the intermediate transfer belt 409 onto a recording medium 500 such as paper. The intermediate transfer belt 409 having passed between the backup roller 408 and the second transfer roller 413 is cleaned by, for example, a cleaning blade 416 placed close to the driving roller 406 or an unshown discharger to be ready for the next cycle of image formation process. Disposed at a prescribed position in the housing 400 is a transfer receiving medium container 411 (e.g., a paper feed tray) for feeding a transfer receiving medium 500 (e.g., a sheet of paper). A transfer receiving medium 500 from the container 411 is transported by transport rollers 412 between the intermediate transfer belt 409 and the second transfer roller 413 and then between a pair of fixing rollers 414 in contact with each other and supplied out of the housing 400.

The process cartridge according to the invention includes the charging member of the invention as a charging roller as shown in the embodiment illustrated in FIG. 1. For example, a process cartridge for yellow image formation includes the charging roller 402*a*, the photoreceptor 401*a*, the cleaning blade 415*a*, and the developing unit 404*a*; a process cartridge for magenta image formation includes the charging roller 402*b*, the photoreceptor 401*b*, the cleaning blade 415*b*, and the developing unit 404*b*; a process cartridge for cyan image formation includes the charging roller 402*c*, the photoreceptor 401*c*, the cleaning blade 415*c*, and the developing unit 404*c*; and a process cartridge for black image formation includes the charging roller 402*d*, the photoreceptor 401*d*, the cleaning blade 415*d*, and the developing unit 404*d*.

EXAMPLE

The invention will be illustrated in more detail with reference to Examples in which the charging member is a charging roller, but it should be understood that the invention is not limited thereto. Unless otherwise noted, all the parts are given by weight. Evaluations in the following examples and comparative examples are performed by the following methods. Also, it will be explained to hold a charging roller as an example of a charging member.

Examples 1 to 11 and Comparative Examples 1 to 3

1. Making Charging Roller 1-1. Making Metal Shaft

A drawn metal tube having an outer diameter of 8 mm is cut to a length of 330 mm and electroless plated with nickel to make a metal shaft.

1-2. Formation of Conductive Elastic Layer

The components shown in Tables 1 and 2 below (given in the weight ratio shown) are kneaded in a tangential type pressure kneader having a net chamber volume of 75 liters (from Moriyama Co., Ltd.), and then in a 22-inch open roll mill to obtain an unvulcanized rubber sheet. The unvulcanized rubber sheet is extruded from a single screw rubber extruder (cylinder inner diameter: 60 mm; L/D: 20) having a crosshead die (inner diameter: 12 mm; nipple diameter: 8 mm), through which the metal shaft passed continuously, and is thereby coated with the extruded unvulcanized rubber. The rotational speed of the screw is 15 rpm, and the extruder temperatures at the cylinder, screw, head, and die are all set at 80° C. The extruded unvulcanized rubber is vulcanized in an oven at 180° C. for 30 minutes at atmospheric pressure to form a conductive elastic layer.

TABLE 1

| | | | Example No. | | | | | | | | | | |
|---|---|---|---|---|---|---|---|---|---|---|---|---|---|
| | Trade Name | Manufacturer | 1 | 2 | 3 | 4 | 5 | 6 | 7 | 8 | 9 | 10 | 11 |
| Epichlorohydrin Rubber | Epion 301 | DAISO CO., LTD. | 90 | 90 | 90 | 90 | 90 | 90 | 90 | 90 | 90 | — | — |
| | Epichlomer DG | DAISO CO., LTD. | — | — | — | — | — | — | — | — | — | 90 | — |
| | Epichlomer CG102 | DAISO CO., LTD. | — | — | — | — | — | — | — | — | — | — | 90 |
| | Ethylene oxide content (mol %) | | 73 | 73 | 73 | 73 | 73 | 73 | 73 | 73 | 73 | 60 | 56 |

TABLE 1-continued

| | Trade Name | Manufacturer | Example No. 1 | 2 | 3 | 4 | 5 | 6 | 7 | 8 | 9 | 10 | 11 |
|---|---|---|---|---|---|---|---|---|---|---|---|---|---|
| Liquid Acrylonitrile Butadiene Copolymer Rubber | N280 | JSR Corporation | 10 | 10 | 10 | 10 | 10 | 10 | 10 | 10 | 10 | 10 | 10 |
| Calcium Oxide | | Calfine CO., LTD. | Flime 400 | — | Flime 900 | Flime 1300 | Flime 2000 | Flime 2000 | Flime 2000 | Flime 2000 | Flime 2000 | Flime 2000 | Flime 2000 |
| | — | Ohmi Chemical Industry Co., Ltd. | — | CML-31 | — | — | — | — | — | — | — | — | — |
| | D50 (μm) | | 18 | 14 | 6 | 4 | 1.7 | 1.7 | 1.7 | 1.7 | 1.7 | 1.7 | 1.7 |
| | Amount | | 5 | 5 | 5 | 5 | 5 | 1 | 3 | 10 | 15 | 5 | 5 |
| Zinc Oxide | Zinc Oxide 2 | Seido Kagaku Industry Co., Ltd. | 5 | 5 | 5 | 5 | 5 | 5 | 5 | 5 | 5 | 5 | 5 |
| Stearic Acid | Stearic Acid S | Kao Corporation | 1 | 1 | 1 | 1 | 1 | 1 | 1 | 1 | 1 | 1 | 1 |
| Carbon | 3030B | Mitsubishi Chemical Corporation | 15 | 15 | 5 | 15 | 15 | 15 | 15 | 15 | 15 | 15 | 15 |
| Quaternary Ammonium Salt | KS-555 | Kao Corporation | 1.5 | 1.5 | 1.5 | 1.5 | 1.5 | 1.5 | 1.5 | 1.5 | 1.5 | 1.5 | 1.5 |
| Calcium Carbonate | Hakuenka CC | Shiraishi Kogyo Kaisha, Ltd. | 30 | 30 | 30 | 30 | 30 | 30 | 30 | 30 | 30 | 30 | 30 |
| Vulcanizing Agent | Sulfax200 | Tsurumi Chemical Industry Co., Ltd. | 1 | 1 | 1 | 1 | 1 | 1 | 1 | 1 | 1 | 1 | 1 |
| Vulcanization Accelerator A | Nocceler DM-P | Ouchi Shinko Chemical Industrial Co., Ltd. | 1.5 | 1.5 | 1.5 | 1.5 | 1.5 | 1.5 | 1.5 | 1.5 | 1.5 | 1.5 | 1.5 |
| Vulcanization Accelerator B | Nocceler TET | Ouchi Shinko Chemical Industrial Co., Ltd. | 0.5 | 0.5 | 0.5 | 0.5 | 0.5 | 0.5 | 0.5 | 0.5 | 0.5 | 0.5 | 0.5 |

TABLE 2

| | Trade Name | Manufacturer | Comparative Example 1 | 2 | 3 |
|---|---|---|---|---|---|
| Epichlorohydrin Rubber | Epion 301 | DAISO CO., LTD. | — | 90 | — |
| | Epichlomer CG105 | DAISO CO., LTD. | 90 | — | 90 |
| | Ethylene oxide content (mol %) | | 48 | 73 | 48 |
| Liquid Acrylonitrile Butadiene Copolymer Rubber | N280 | JSR Corporation | 10 | 10 | 10 |
| Calcium Oxide | | Calfine CO., LTD. | Flime 100 | Flime 100 | Flime 400 |
| | D50 (μm) | | 28 | 28 | 18 |
| | Amount | | 5 | 5 | 5 |
| Zinc Oxide | Zinc oxide class 2 | Seido Kagaku Industry Co., Ltd. | 5 | 5 | 5 |
| Stearic Acid | Steraric Acid S | Kao Corporation | 1 | 1 | 1 |
| Carbon | 3030B | Mitsubishi Chemical Corporation | 15 | 15 | 15 |
| Quaternary Ammonium Salt | KS-555 | Kao Corporation | 1.5 | 1.5 | 1.5 |
| Calcium Carbonate | Hakuenka CC | Shiraishi Kogyo Kaisha, Ltd. | 30 | 30 | 30 |
| Vulcanizing Agent | Sulfax200 | Tsurumi Chemical Industry Co., Ltd. | 1 | 1 | 1 |
| Vulcanization Accelerator A | Nocceler DM-P | Ouchi Shinko Chemical Industrial Co., Ltd. | 1.5 | 1.5 | 1.5 |

TABLE 2-continued

| | Trade Name | Manufacturer | Comparative Example 1 | 2 | 3 |
|---|---|---|---|---|---|
| Vulcanization Accelerator B | Nocceler TET | Ouchi Shinko Chemical Industrial Co., Ltd. | 0.5 | 0.5 | 0.5 |

1-3. Formation of Surface Layer

The following components are dispersed in a bead mill to prepare a coating solution. After diluting the solution by adding methanol, the coating solution is applied to the surface of the conductive elastic layer (substrate) by dipping the substrate into the coating solution and thereby coating the substrate with appropriate control of the initial coating speed and acceleration, followed by drying by heating at 120° C. for 20 minutes to form a 10 μm thick surface layer. In this way, the surface layer of the charging roller is obtained.

Formulation of Surface Layer:

| | |
|---|---|
| Copolymer nylon Aramine CM8000 from Toray Co., Ltd. | 100 parts |
| Carbon black MONARCH 1000 from Cabot Corp. (conducting agent) | 14 parts |
| Methanol (solvent) | 500 parts |
| Butanol (solvent) | 240 parts |

2. Evaluation of Charging Roller 2-1. Foaming

A cross-section of the conductive elastic layer is observed under a digital microscope VHX-900 from Keyence Corporation at 25 magnifications to inspect for foaming. The state of foaming is evaluated as follows.

AA: No foams are observed.

A: One or two foams of 100 μm or smaller in diameter and no foam greater than 100 μm are observed within a 2 $mm^2$ area.

B: Three to five foams of 100 μm or smaller in diameter or one or two foams of 100 to 200 μm in diameter are observed within a 2 $mm^2$ area.

C: More than six foams of 100 μm or smaller in diameter, or more than two foams of 100 to 200 μm in diameter, or one or more foams greater than 200 μm in diameter are observed within a 2 $mm^2$ area.

2-2. Surface Roughness (Rz)

The surface roughness in terms of Rz of the charging roller is determined using a profilometer Surfcom 1500 DX-12 from Tokyo Seimitsu Co., Ltd. in accordance with JIS B0601-1994 under conditions of an evaluation length of 4.0 mm, a cut-off value of 0.8 mm, and a scanning speed of 0.30 mm/sec. The measurement is taken along the axial direction of the roller at three points: 5 mm from both ends of the roller and the axial center of the roller, to obtain an average. The surface roughness is evaluated according to the parameter Rz as follows.

AA: Rz of 8 μM or less.

A: Rz of more than 8 μm and not more than 10 tam.

B: Rz of more than 10 μm and not more than 15 μm.

C: Rz of more than 15 μm.

2-3. Volume Resistance

The unvulcanized rubber sheet obtained in aforementioned 1-2 is shaped in a press at 180° C. for 30 minutes into a 150 mm by 150 mm by 2 mm thick sheet, After seasoning the sheet at 22° C. and 55% RH for at least 24 hours, the volume resistance of the sheet is measured using a digital ultra-high resistance/micro current meter (Model R8340A, from ADC Corp.), a UR probe (MCP-HTP12, from Dia Instruments) having a double ring-electrode structure the connector of which is modified in conformity to R8340A, and a Resitable UFL MCP-ST03 (from Mitsubishi Chemical Analytech Co., Ltd.) in accordance with JIS K6911 under conditions of a charge time of 30 seconds, a discharge time of 1 second, and an applied voltage of 100 V. The measured volume resistance is evaluated as follows.

AA: A common logarithm of the resistance (log Ωcm) is less than 6.5.

A: A common logarithm of the resistance (log Ωcm) is 6.5 or more and less than 7.0.

B: A common logarithm of the resistance (log Ωcm) is 7.0 or more and less than 7.5.

C: A common logarithm of the resistance (log Ωcm) is 7.5 or more.

2-4. Image Quality

The charging roller is mounted on a copier Apeos Port-IV C5570 from Fuji Xerox Co., Ltd. A printing test is carried out in a continuous mode at 28° C. and 85% RH to obtain 25,000 sheets of A4 size prints and subsequently at 10° C. and 15% RH to obtain 25,000 sheets of A4 size prints. When any serious trouble occurred before accomplishing a total of 50,000 prints, the test is stopped at that time. The initial print and the print after the 50,000 prints are visually inspected for density unevenness in the halftone image area to evaluate the image quality according to the following rating system.

AA: No image defects such as density unevenness.

A: Very slight density unevenness.

B: Slight density unevenness.

C: Practically unacceptable density unevenness.

The results of evaluations are shown in Tables 3 and 4.

TABLE 3

| | Example 1 | 2 | 3 | 4 | 5 | 6 | 7 | 8 | 9 | 10 | 11 |
|---|---|---|---|---|---|---|---|---|---|---|---|
| Ethylene Oxide Content (mol %) | 73 | 73 | 73 | 73 | 73 | 73 | 73 | 73 | 73 | 60 | 56 |
| Particle Size D50 of Calcium Oxide (μm) | 18 | 14 | 6 | 4 | 1.7 | 1.7 | 1.7 | 1.7 | 1.7 | 1.7 | 1.7 |
| Calcium Oxide Content (part) | 5 | 5 | 5 | 5 | 5 | 1 | 3 | 10 | 15 | 5 | 5 |

TABLE 3-continued

| | Example | | | | | | | | | | |
|---|---|---|---|---|---|---|---|---|---|---|---|
| | 1 | 2 | 3 | 4 | 5 | 6 | 7 | 8 | 9 | 10 | 11 |
| Foaming | B | A | AA | AA | AA | B | AA | AA | AA | AA | AA |
| Rz | A | A | AA | AA | AA | AA | AA | AA | B | AA | AA |
| Volume Resistance | AA | AA | AA | AA | AA | AA | AA | AA | AA | A | B |
| Density Unevenness | A | A | AA | AA | AA | AA | AA | AA | B | A | B |

TABLE 4

| | Comparative Example | | |
|---|---|---|---|
| | 1 | 2 | 3 |
| Ethylene Oxide Content (mol %) | 48 | 73 | 48 |
| Particle Size D50 of Calcium Oxide (μm) | 28 | 28 | 18 |
| Calcium Oxide Content (part) | 3 | 15 | 20 |
| Foaming | C | A | AA |
| Rz | B | C | C |
| Volume Resistance | C | A | C |
| Density Unevenness | C | C | C |

INDUSTRIAL APPLICABILITY

The present invention is applicable to electrophotographic image forming apparatus such as copiers and printers.

While the present invention has been shown and described with reference to certain exemplary embodiments thereof, it will be understood by those skilled in the art that various changes modifications may be made therein without departing from the spirit and scope of the present invention as defined by the appended claims.

What is claimed is:

1. A charging member comprising:

a conductive metal shaft; and a conductive elastic layer on the shaft, wherein the conductive elastic layer comprises:

a rubber material; and a calcium oxide having an average particle size D50 of 18 μm or smaller, and wherein the rubber material contains 50% to 100% by weight of epichlorohydrin rubber containing 56 mol % or more of an ethylene oxide.

2. The charging member according to claim 1, wherein the rubber material contains 50% to 100% by weight of epichlorohydrin rubber containing 60 mol % or more of an ethylene oxide.

3. The charging member according to claim 1, wherein the rubber material contains 50% to 100% by weight of epichlorohydrin rubber containing 70 mol % or more of an ethylene oxide.

4. The charging member according to claim 1, wherein the calcium oxide is present in an amount of 1 to 15 parts by weight based on 100 parts by weight of the rubber material.

5. The charging member according to claim 1, wherein the calcium oxide is present in an amount of 3 to 10 parts by weight based on 100 parts by weight of the rubber material.

6. The charging member according to claim 1, wherein the calcium oxide having an average particle size D50 of 14 μm or smaller.

7. The charging member according to claim 1, wherein the calcium oxide having an average particle size D50 of 6 μm or smaller.

8. A removable process unit cartridge comprising:

an image carrier; and a charging unit being in contact with the image carrier and adapted to charge the surface of the image carrier, wherein the charging unit comprises the charging member according to claim 1.

9. An image fowling apparatus comprising:

an image carrier; and a charging unit being in contact with the image carrier and adapted to charge the surface of the image carrier, wherein the charging unit comprises the charging member according to claim 1.

* * * * *